US010669846B2

(12) United States Patent
Yang

(10) Patent No.: US 10,669,846 B2
(45) **Date of Patent: *Jun. 2, 2020**

(54) APPARATUS, COMPUTER READABLE MEDIUM, AND PROGRAM CODE FOR EVALUATING ROCK PROPERTIES WHILE DRILLING USING DOWNHOLE ACOUSTIC SENSORS AND A DOWNHOLE BROADBAND TRANSMITTING SYSTEM

(71) Applicant: Saudi Arabian Oil Company, Dhahran (SA)

(72) Inventor: Yunlai Yang, Ras Tanura (SA)

(73) Assignee: Saudi Arabian Oil Company, Dhahran (SA)

( * ) Notice: Subject to any disclaimer, the term of this patent is extended or adjusted under 35 U.S.C. 154(b) by 154 days.

This patent is subject to a terminal disclaimer.

(21) Appl. No.: 15/987,389

(22) Filed: May 23, 2018

(65) Prior Publication Data

US 2018/0266246 A1 Sep. 20, 2018

Related U.S. Application Data

(60) Continuation of application No. 15/233,541, filed on Aug. 10, 2016, now Pat. No. 10,036,246, which is a (Continued)

(51) Int. Cl.
*G01V 1/40* (2006.01)
*E21B 49/00* (2006.01)
(Continued)

(52) U.S. Cl.
CPC ..... *E21B 49/003* (2013.01); *E21B 7/04* (2013.01); *E21B 47/14* (2013.01); *E21B 49/00* (2013.01)

(58) Field of Classification Search
None
See application file for complete search history.

(56) References Cited

U.S. PATENT DOCUMENTS 2,155,609 A 4/1939 Owsley et al.
3,583,219 A 6/1971 Lunstroth et al.
(Continued)

FOREIGN PATENT DOCUMENTS

CA 2508404 A1 11/2006
EP 0718641 A2 6/1996
(Continued)

OTHER PUBLICATIONS

European Examination Report for Application No. 12783703.7; dated Jan. 20, 2017; (pp. 1-6)
(Continued)

*Primary Examiner* — Aditya S Bhat
(74) *Attorney, Agent, or Firm* — Bracewell LLP; Constance G. Rhebergen; Brian H. Tompkins

(57) ABSTRACT

Apparatus, computer readable medium, and program code for identifying rock properties in real-time during drilling, are provided. An example of an embodiment of such an apparatus includes a downhole sensor subassembly connected between a drill bit and a drill string, acoustic sensors operably coupled to a downhole data interface, and a surface computer operably coupled to the downhole data interface. The computer can include a petrophysical properties analyzing program configured or otherwise adapted to perform various operations including receiving raw acoustic sensor data generated real-time as a result of rotational contact of the drill bit with rock during drilling, transforming the raw acoustic sensor data into the frequency domain, filtering the transformed data, deriving a plurality of acoustic characteristics from the filtered data and deriving petrophysical properties from the filtered data utilizing a petrophysical
(Continued)

properties evaluation algorithm employable to predict one or more petrophysical properties of rock undergoing drilling.

19 Claims, 8 Drawing Sheets

Related U.S. Application Data division of application No. 13/554,077, filed on Jul. 20, 2012, now Pat. No. 9,447,681.

(60) Provisional application No. 61/539,165, filed on Sep. 26, 2011.

(51) Int. Cl.
*E21B 7/04* (2006.01)
*E21B 47/14* (2006.01)

(56) References Cited

U.S. PATENT DOCUMENTS 3,626,482 A 12/1971 Raynaud et al.
3,948,322 A 4/1976 Baker
3,980,986 A 9/1976 Baird et al.
4,303,994 A 12/1981 Tanguy
4,349,071 A 9/1982 Fish
4,578,675 A 3/1986 MacLeod
4,715,451 A 12/1987 Bseisu et al.
4,928,521 A 5/1990 Jardine
4,964,087 A 10/1990 Widrow
4,965,774 A 10/1990 Ng et al.
4,992,997 A 2/1991 Bseisu
5,109,925 A 5/1992 Stepp et al.
5,128,901 A 7/1992 Drumheller
5,141,061 A 8/1992 Henneuse
5,144,298 A 9/1992 Henneuse
5,159,226 A 10/1992 Montgomery
5,248,857 A 9/1993 Ollivier
5,272,925 A 12/1993 Henneuse et al.
5,289,354 A 2/1994 Clayer et al.
5,303,203 A 4/1994 Kingman
5,347,859 A 9/1994 Henneuse et al.
5,448,227 A 9/1995 Richardson et al.
5,448,911 A 9/1995 Mason
5,510,582 A 4/1996 Birchak et al.
5,602,541 A 2/1997 Wallis et al.
5,678,643 A 10/1997 Minear et al.
5,738,171 A 4/1998 Szarka
5,774,418 A 6/1998 Magendie et al.
5,924,499 A 7/1999 Gardner et al.
6,023,444 A 2/2000 Naville et al.
6,199,018 B1 3/2001 Quist et al.
6,267,185 B1 7/2001 Hutin et al.
6,320,820 B1 11/2001 Gardner et al.
6,520,257 B2 2/2003 Allamon et al.
6,583,729 B1 6/2003 Gardner et al.
6,648,082 B2 11/2003 Schultz et al.
6,681,185 B1 1/2004 Young et al.
6,681,633 B2 1/2004 Osborne, Jr. et al.
6,712,160 B1 3/2004 Osborne, Jr. et al.
6,714,138 B1 3/2004 Biglin, Jr. et al.
6,891,481 B2 5/2005 Dubinsky et al.
6,909,667 B2 6/2005 Dudley et al.
6,920,085 B2 7/2005 Warren et al.
6,940,420 B2 9/2005 Jenkins
7,036,363 B2 5/2006 Yogeswaren
7,068,183 B2 6/2006 Kyle et al.
7,142,986 B2 11/2006 Moran
7,274,992 B2 9/2007 Dewhurst et al.
7,289,909 B2 10/2007 Thomann et al.
7,357,197 B2 4/2008 Schultz et al.
7,404,456 B2 * 7/2008 Weaver ..... G01V 1/50 175/39
7,458,257 B2 12/2008 Pop et al.
7,480,207 B2 1/2009 Marsh
7,516,015 B2 4/2009 Sinha et al.
7,530,407 B2 * 5/2009 Tchakarov ..... E21B 49/06 175/20
7,571,777 B2 8/2009 Wylie et al.
7,590,029 B2 9/2009 Tingley
7,652,951 B2 1/2010 Leggett et al.
7,675,816 B2 3/2010 Mathiszik et al.
7,735,579 B2 6/2010 Gopalan et al.
7,757,759 B2 7/2010 Jahn et al.
7,764,572 B2 7/2010 Wu et al.
7,817,062 B1 10/2010 Li et al.
7,841,425 B2 11/2010 Guimerans et al.
7,859,426 B2 12/2010 Clark et al.
7,913,773 B2 3/2011 Li et al.
7,966,874 B2 6/2011 Hassan et al.
7,974,451 B2 7/2011 Matsumoto
8,004,421 B2 8/2011 Clark
8,281,856 B2 10/2012 Jahn et al.
8,798,978 B2 8/2014 Ertas et al.
9,234,974 B2 1/2016 Yang
9,568,629 B2 2/2017 Almarhoon et al.
9,624,768 B2 4/2017 Yang
9,664,039 B2 5/2017 Neale et al.
2002/0096363 A1 7/2002 Evans et al.
2002/0116128 A1 8/2002 Sinha et al.
2002/0195276 A1 12/2002 Dubinsky et al.
2003/0010495 A1 1/2003 Mendez et al.
2003/0072217 A1 4/2003 MacPherson
2003/0168257 A1 9/2003 Aldred et al.
2004/0159428 A1 8/2004 Hammond et al.
2004/0200613 A1 10/2004 Fripp et al.
2005/0100414 A1 5/2005 Salama
2006/0076161 A1 * 4/2006 Weaver ..... E21B 49/003 175/50
2006/0120217 A1 6/2006 Wu et al.
2007/0030762 A1 2/2007 Huang et al.
2007/0189119 A1 8/2007 Klotz et al.
2008/0056067 A1 3/2008 Jogi et al.
2008/0285386 A1 11/2008 Sinanovic et al.
2009/0067286 A1 3/2009 Bose et al.
2009/0195408 A1 8/2009 Patterson et al.
2009/0199072 A1 8/2009 Akimov et al.
2009/0201170 A1 8/2009 Reckmann et al.
2009/0250225 A1 10/2009 Zaeper et al.
2010/0008188 A1 1/2010 Hall et al.
2010/0038135 A1 2/2010 Hummes et al.
2010/0118657 A1 5/2010 Trinh et al.
2010/0195442 A1 8/2010 Reyes et al.
2010/0200295 A1 8/2010 Schimanski et al.
2010/0268491 A1 10/2010 Brink et al.
2010/0284247 A1 11/2010 Manning et al.
2010/0305864 A1 12/2010 Gies
2011/0005835 A1 1/2011 Li
2011/0067928 A1 3/2011 Huldén et al.
2011/0073303 A1 3/2011 Taherian et al.
2011/0164468 A1 7/2011 Robbins et al.
2012/0273270 A1 11/2012 Rasheed
2013/0075157 A1 3/2013 Yang et al.
2013/0075159 A1 3/2013 Yang
2013/0075160 A1 3/2013 Yang
2013/0075161 A1 3/2013 Yang
2013/0080060 A1 3/2013 Yang
2013/0080065 A1 3/2013 Yang
2018/0171772 A1 6/2018 Rodney

FOREIGN PATENT DOCUMENTS

EP 2236744 A2 10/2010
GB 2288197 A 10/1995
WO 199727502 A1 7/1997
WO 2013049014 A1 4/2013
WO 2013049044 A1 4/2013
WO 2013049111 A1 4/2013
WO 2013049124 A1 4/2013

(56) References Cited

FOREIGN PATENT DOCUMENTS

| | | | |
|---|---|---|---|
| WO | 2013049140 | A1 | 4/2013 |
| WO | 2013049158 | A1 | 4/2013 |

OTHER PUBLICATIONS

Final Office Action for co-pending U.S. Appl. No. 13/553,958 dated Dec. 17, 2015; 30 pages.
Final Office Action for co-pending U.S. Appl. No. 13/554,019 dated Jan. 22, 2016; 12 pages.
Gao, DVL Technology, retrieved at http://chinada-international.com/Tech/e_index.htm on Jul. 18, 2011, 2 pages.
Gao, L., et al.; "Limits on Data Communication Along the Drillstring Using Acoustic Waves" Society of Petroleum Engineers, SPE Annual Technical Conference and Exhibition, Oct. 9-12, 2005, paper No. 95490-MS, Dallas, TX (1 page).
Gradi, Christian et al.; "An Analysis of Noise Characteristics of Drill Bits" Society of Petroleum Engineers, SPE Annual Technical Conference and Exhibition, Sep. 21-24, 2008, paper No. 115987-MS, Denver, CO. (1 page).
Gwilliam, W. et al.; "Advanced Seismic While Drilling System" Oil & Natural Gas Projects, Exploration & Production Technologies, DE-FC26-04NT42242, Technology International, Inc., Kingwood, TX, Sep. 30, 2006 (2 pages).
International Search Report and Written Opinion for related PCT Application No. PCT/US2012/028994; Report dated Sep. 4, 2013 (pp. 1-16).
International Search Report and Written Opinion for related PCT Application No. PCT/US2012/057039; Report dated Aug. 21, 2013 (pp. 1-12).
International Search Report and Written Opinion for related PCT Application No. PCT/US2012/057084; Report dated Aug. 21, 2013 (pp. 1-11).
International Search Report and Written Opinion for related PCT Application No. PCT/US2012/057201; Report dated Sep. 25, 2013 (pp. 1-14).
International Search Report and Written Opinion for related PCT Application No. PCT/US2012/057222; Report dated Aug. 7, 2013 (pp. 1-10).
International Search Report and Written Opinion for related PCT Application No. PCT/US2012/057244; Report dated Sep. 23, 2013 (pp. 1-11).
Kristensen et al. "Characteristics of Drill Bit Generated Noise" Paper No. 1990-X, Society of Petrophysicists & Well Log Analysts, SPWLA 31st Annual Logging Symposium, 1990 (1 page).
Myers, G. et al.; "Drill String Vibration: A Proxy for Identifying Lithologic Boundaries While Drilling, Proceeding of the Ocean Drilling Program Scientific Results" Proceedings of the Ocean Drilling Program, Scientific Results vol. 179 (pp. 1-17).
Nakanishi, Shoichi; "Feasibility study of Seismic—While Drilling using hammer drilling technology" Report No. GPM 4/99 Department of Exploration Geophysics, Nov. 1999 (pp. 1-120).
Non-Final Office Action for co-pending U.S. Appl. No. 13/554,470 dated Nov. 13, 2014 (46 pages).
Non-Final Office Action for co-pending U.S. Appl. No. 13/554,369 dated Aug. 16, 2017; 14 pgs.
Non-Final Office Action issued in U.S. Appl. No. 15/233,541 dated Sep. 22, 2017; 10 pgs.
Non-Office Action for co-pending U.S. Appl. No. 13/553,958 dated Apr. 16, 2015; 25 pages.
Non-Office Action for co-pending U.S. Appl. No. 13/554,019 dated Feb. 20, 2015; 62 pages.
Non-Office Action for co-pending U.S. Appl. No. 13/554,019 dated Jul. 8, 2015 (42 pages).
Non-Office Action for co-ending U.S. Appl. No. 13/554,298 dated Feb. 26, 2015 (41 pages).
Notice of Allowance for co-pending U.S. Appl. No. 13/554,298 dated Oct. 29, 2015; 14 pages.
Notice of Allowance for co-pending U.S. Appl. No. 13/554,470 dated Mar. 2, 2015; 15 pages.
Radtke et al., Advanced Seismic While Drilling System, Oil & Natural Gas Technology, Jun. 2008, 65 pages.
Schlumberger "Drillpipe" retrieved at http://www.glossary.oilfield.slb.com/en/Terms/d/drillpipe.aspx, 2013 (1 page).
Schlumberger "Drillstring" retrieved at http://www.glossary.oilfield.slb.com/en/Terms/d/drillstring.aspx, 2013 (1 page).
Sun, X.; "A Study of Acoustic Emission in Drilling Applications, American Rock Mechanics Association" The 37th U.S. Symposium on Rock Mechanics (USRMS), Jun. 7-9, 1999, paper No. 99/0983, Vail, CO. (1 page).
Vardhan, H. et al.; "Estimating Rock Properties Using Sound Levels Produced During Drilling" International Journal of Rock Mechanics & Mining Sciences, (2009), vol. 46, pp. 604-612.
Veeningen, D., NOV-IntelliServ, USA, Describes How Broadband Network Expands Possibilities for Drilling Extend Reach Multilateral Wells, Oilfield Technology, Jun. 2009, www.oilfieldtechnology.com (4 pages).

* cited by examiner

APPARATUS, COMPUTER READABLE MEDIUM, AND PROGRAM CODE FOR EVALUATING ROCK PROPERTIES WHILE DRILLING USING DOWNHOLE ACOUSTIC SENSORS AND A DOWNHOLE BROADBAND TRANSMITTING SYSTEM

RELATED APPLICATIONS

This application is a continuation of and claims priority to U.S. patent application Ser. No. 15/233,541, titled "Apparatus, Computer Readable Medium, And Program Code For Evaluating Rock Properties While Drilling Using Downhole Acoustic Sensors And A Downhole Broadband Transmitting System," filed on Aug. 10, 2016, which is a divisional of and claims priority to U.S. patent application Ser. No. 13/554,077, titled "Apparatus, Computer Readable Medium, And Program Code For Evaluating Rock Properties While Drilling Using Downhole Acoustic Sensors And A Downhole Broadband Transmitting System," filed on Jul. 20, 2012, which is a non-provisional of and claims priority to and the benefit of U.S. Provisional Patent Application No. 61/539,165, titled "Apparatus And Program Product For Evaluating Rock Properties While Drilling Using Downhole Acoustic Sensors And A Downhole Broadband Transmitting System," filed on Sep. 26, 2011, each incorporated herein by reference in its entirety. This application is related to U.S. patent application Ser. No. 13/554,369, filed on Jul. 20, 2012, titled "Methods of Evaluating Rock Properties While Drilling Using Downhole Acoustic Sensors and a Downhole Broadband Transmitting System"; U.S. patent application Ser. No. 13/554,019, filed on Jul. 20, 2013, titled "Apparatus, Computer Readable Medium and Program Code for Evaluating Rock Properties While Drilling Using Downhole Acoustic Sensors and Telemetry System"; U.S. patent application Ser. No. 13/553,958, filed on Jul. 20, 2012, titled "Methods of Evaluating Rock Properties While Drilling Using Downhole Acoustic Sensors and Telemetry System"; U.S. patent application Ser. No. 13/554,298, filed on Jul. 20, 2012, titled "Apparatus for Evaluating Rock Properties While Drilling Using Drilling Rig-Mounted Acoustic Sensors"; and U.S. patent application Ser. No. 13/554,470, filed on Jul. 20, 2012, titled "Methods for Evaluating Rock Properties While Drilling Using Drilling Rig-Mounted Acoustic Sensors"; U.S. Provisional Patent Application No. 61/539,171, titled "Methods Of Evaluating Rock Properties While Drilling Using Downhole Acoustic Sensors And A Downhole Broadband Transmitting System," filed on Sep. 26, 2011; U.S. Provisional Patent Application No. 61/539,201, titled "Apparatus For Evaluating Rock Properties While Drilling Using Drilling Rig-Mounted Acoustic Sensors," filed on Sep. 26, 2011; U.S. Provisional Patent Application No. 61/539,213, titled "Methods For Evaluating Rock Properties While Drilling Using Drilling Rig-Mounted Acoustic Sensors," filed on Sep. 26, 2011; U.S. Provisional Patent Application No. 61/539,242 titled "Apparatus And Program Product For Evaluating Rock Properties While Drilling Using Downhole Acoustic Sensors And Telemetry System," filed on Sep. 26, 2011; and U.S. Provisional Patent Application No. 61/539,246 titled "Methods Of Evaluating Rock Properties While Drilling Using Downhole Acoustic Sensors And Telemetry System," filed on Sep. 26, 2011, each incorporated herein by reference in its entirety.

BACKGROUND OF THE INVENTION

Field of the Invention

This invention relates in general to hydrocarbon production, and more particularly, to identifying rock types and rock properties in order to improve or enhance drilling operations.

Description of the Related Art

Measuring rock properties during drilling in real time can provide the operator the ability to steer a drill bit in the direction of desired hydrocarbon concentrations. In current industrial practice and prior inventions, either resistivity or sonic logging while drilling (LWD) tools are employed to guide the drill bit during horizontal or lateral drilling. The center of these techniques is to calculate the locations of the boundary between the pay zone and the overlying rock (upper boundary), and the boundary between the pay zone and underlying rock at the sensors location. The drill bit is steered or maintained within the pay zone by keeping the drill string, at the sensors position, in the middle, or certain position between the upper and lower boundaries of the pay zone. The conventional borehole acoustic telemetry system, which transmits data at low rate (at about tens bit per second), is employed to transmit the measured data to surface.

Since the sensors are located 30-50 feet behind the drill bit, theses conventional LWD steering tools only provide data used in steering the drill bit 30-50 feet behind the drill bit. As the result, it is only after the 30-50 feet that the operator finds out if the selected drilling path is or is not the desired one. Therefore, these tools are not true real-time tools.

Some newer types of systems attempt to provide data at the drill bit, at real-time, while still utilizing conventional borehole telemetry systems (having a relatively slow bit rate). Such systems, for example, are described as including a downhole processor configured to provide downhole on-site processing of acoustic data to interpret the lithologic properties of the rock encountered by the drill bit through comparison of the acoustic energy generated by the drill bit during drilling with predetermined bit characteristics generated by rotating the drill bit in contact with a known rock type. The lithologic properties interpreted via the comparison are then transmitted to the surface via the conventional borehole telemetry system. Although providing data in a reduced form requiring only a bit rate speed, as such systems do not provide raw data real-time which can be used for further analysis, it is nearly impossible to construct additional interpretation models or modify any interpretation models generated by the downhole processor.

Some newer types of borehole data transmitting systems utilize a dedicated electronics unit and a segmented broadband cable protected by a reinforced steel cable positioned within the drill pipe to provide a much faster communication capability. Such systems have been employed into conventional LWD tools to enhance the resolution of the logged information. However the modified tools still measures rock properties at the similar location which is 30-50 feet behind the drill bit.

Accordingly, recognized by the inventor is the need for apparatus, computer readable medium, program code, and methods of identifying rock properties in real-time during drilling, and more particularly, apparatus having acoustic sensors adjacent the drill bit positioned to detect drill sounds during drilling operations, a broadband transmitting system for pushing the raw acoustic sensor data to a surface computer and a computer/processor positioned to receive raw acoustic sensor data and configured to derive the rock type and to evaluate the properties of the rocks in real-time utilizing the raw acoustic sensor data.

SUMMARY OF THE INVENTION

In view of the foregoing, various embodiments of the present invention advantageously provide apparatus, computer readable medium, program code, and methods of identifying rock types and rock properties of rock that is currently in contact with an operationally employed drilling bit, which can be used in real-time steering of the drilling bit during drilling. Various embodiments of the present invention provide apparatus having acoustic sensors adjacent the drill bit positioned to detect drill sounds during drilling operations, a broadband transmitting system for pushing the raw acoustic sensor data to a surface computer, and a computer/processor positioned to receive raw acoustic sensor data and configured to derive the rock type and to evaluate the properties of the rocks in real-time.

According to various embodiments of the present invention, the computer/processor is a surface computer which receives the raw acoustic sensor data. Utilizing the raw acoustic sensor data, the computer can advantageously function to derive a frequency distribution of the acoustic sensor data, derive acoustic characteristics from the raw acoustic data, and determine petrophysical properties of rock from the raw acoustic sensor data. The acoustic characteristics can advantageously further be used to identify the lithology type of the rock encountered by the drill bit, to determine the formation boundary, to determine an optimal location of the casing shoe, among other applications. According to various embodiments of the present invention, to determine petrophysical properties of the rock directly from the raw acoustic sensor data (generally after being converted into the frequency domain and filtered), a petrophysical properties evaluation algorithm can be derived from acoustic sensor data and correspondent petrophysical properties of formation samples.

More specifically, an example of an embodiment of an apparatus for identifying rock properties of rock in real-time during operational drilling, to include identifying lithology type and other petrophysical properties, can include both conventional components and additional/enhanced acoustic components. Some primary conventional components of the apparatus include a drill string including a plurality of drill pipes each having an inner bore, a drill bit connected to the downhole end of the drill string, and a top drive system for rotating the drill string having both rotating and stationary portion. The additional/acoustic components of the apparatus can include a downhole sensor subassembly connected to and between the drill bit and the drill string, acoustic sensors (e.g. accelerometer, measurement microphone, contact microphone, hydrophone) attached to or contained within the downhole sensor subassembly adjacent the drill bit and positioned to detect drill sounds during drilling operations. The apparatus can also include a broadband transmitting system operably extending through the inner bore of each of the plurality of drill pipes and operably coupled to the acoustic sensors through the downhole data transmitting interface position therewith, a surface data transmitting interface typically connected to a stationary portion of the top drive system, a surface data acquisition unit connected to the surface data transmitting interface, and a surface computer operably coupled to the downhole data transmitting interface through the data acquisition unit, the surface data transmitting interface, and the broadband transmitting system.

According to an embodiment of the apparatus, the computer includes a processor, memory in communication with the processor, and a petrophysical properties analyzing program, which can adapt the computer to perform various operations. The operations can include, for example, sending sampling commands to the data acquisition unit, receiving raw acoustic data from the downhole data transmitting interface, processing the received raw acoustic sensor data—deriving a frequency distribution of the acoustic data from the raw acoustic data, employing an acoustics characteristics evaluation algorithm to thereby derive acoustic characteristics from the raw acoustic sensor data (e.g., via analysis of the processed acoustics data), and employing a petrophysical properties evaluation algorithm to thereby derive petrophysical properties of rock undergoing drilling, real-time, from the acoustics data.

According to an embodiment of the apparatus, the acoustic characteristics evaluation algorithm evaluates filtered Fast Fourier Transform data for acoustic characteristics. The acoustic characteristics can include mean frequency, normalized deviation of frequency, mean amplitude, normalized deviation of amplitude, and apparent power. These characteristics can be predetermined for rock samples having a known lithology type and/or petrophysical properties, and thus, can be used to identify lithology type and other properties by comparing such characteristics of the acoustic data received during drilling to that determined for the rock samples. According to another embodiment of the apparatus, the computer uses the derived acoustic characteristics to determine formation boundaries based on real-time detection of changes in the lithology type of the rock being drilled and/or petrophysical properties thereof.

According to an exemplary configuration, the petrophysical properties analyzing program or separate program functions to derive a "bit specific" or "bit independent" petrophysical properties evaluation algorithm. Similarly, the derived bit specific or bit independent petrophysical properties evaluation algorithm evaluates filtered Fast Fourier Transform data for petrophysical properties. This petrophysical property data can advantageously be applied by other applications to include real-time lithology type identification, formation boundary determination, casing shoe position fine-tuning, etc.

According to an embodiment of the present invention, the petrophysical properties analyzing program can be provided either as part of the apparatus or as a standalone deliverable. As such, the petrophysical properties analyzing program can include a set of instructions, stored or otherwise embodied on a non-transitory computer readable medium, that when executed by a computer, cause the computer to perform various operations. These operations can include the operation of receiving raw acoustic sensor data from a surface data interface in communication with a communication medium that is further in communication with a downhole data interface operably coupled to a plurality of acoustic sensors. The operations can also include the processing operations of deriving a frequency distribution of the raw acoustic sensor data, deriving a plurality of acoustic characteristics including mean frequency and normalized deviation of frequency from the raw acoustic sensor data, and/or deriving petrophysical properties from the raw acoustic sensor data utilizing a derived petrophysical properties evaluation algorithm employable to predict one or more petrophysical properties of rock undergoing drilling.

According to an embodiment of the program, the operation of deriving a frequency distribution of the acoustic data from the raw acoustic sensor data includes transforming the raw acoustic sensor data into the frequency domain (e.g., employing a Fast Fourier Transform), and filtering the transformed data.

According to an embodiment of the petrophysical properties analyzing program, the operation of deriving the plurality of acoustic characteristics from the raw acoustic sensor data can include comparing the mean frequency, the normalized deviation of frequency, the mean amplitude, the normalized deviation of amplitude, and the apparent power of the rock undergoing drilling with the mean frequency, normalized deviation of frequency, mean amplitude, normalized deviation of amplitude, and the apparent power of a plurality of rock samples having different known lithologies according to a first configuration, or comparing only part of acoustic characteristics, such as the mean frequency and the normalized deviation of frequency of the rock undergoing drilling with the same type of the acoustic characteristics of a plurality of rock samples having different known lithologies according to another configuration. The operations can also include identifying lithology type of the rock undergoing drilling, determining a location of a formation boundary encountered during drilling, and/or identifying an ideal location for casing shoe positioning, among others.

According to an exemplary implementation, the mean frequency and normalized deviation of frequency are examined together to determine an amount of correlation of the acoustic characteristics associated with the rock undergoing drilling and the acoustic characteristics associated with the rock samples. Also or alternatively, the mean frequency and the mean amplitude can be examined together and/or with normalized deviation of frequency and/or normalized deviation of amplitude and apparent power, or a combination thereof. The operation of comparing can beneficially be performed substantially continuously during drill bit steering in order to provide enhanced steering ability.

According to an embodiment of the petrophysical properties analyzing program employing a bit-specific evaluation methodology, the operation of deriving petrophysical properties from the raw acoustic sensor data can include deriving a bit-specific petrophysical properties evaluation algorithm. The derivation of the algorithm can include collecting petrophysical properties data describing one or more petrophysical properties of rock for a plurality of formation samples and correspondent acoustic data for a preselected type of drill bit, processing the collected acoustic data to produce filtered FFT data, and determining one or more relationships between features of the filtered FFT data and correspondent one or more petrophysical properties of rock describing petrophysical properties of the plurality of formation samples. This can be accomplished, for example, by utilizing mathematical modeling techniques such as, multiple regression analysis, artificial neural network modeling, etc. The derivation of the algorithm can also include coding the determined relationships into computer program code defining the petrophysical properties evaluation algorithm. The operations can correspondingly include employing the derived petrophysical properties evaluation algorithm to predict one or more petrophysical properties of the rock undergoing drilling real-time responsive to filtered data associated with raw acoustic sensor data produced in response to the drilling.

According to another embodiment of the petrophysical properties analyzing program employing a bit-independent evaluation methodology, the petrophysical properties evaluation algorithm derivation can also or alternatively include collecting petrophysical properties data describing one or more petrophysical properties of rock for a plurality of formation samples and correspondent acoustic data for a plurality of different types of drill bits, processing the collected acoustic data to produce filtered FFT data, determining bit-type independent features of the filtered FFT data, and determining one or more relationships between the bit-type independent features of the filtered FFT data and correspondent one or more petrophysical properties of the rock to provide a bit-independent evaluation methodology. The algorithm derivation can also include coding the determined relationships into computer program code defining a bit-independent petrophysical properties evaluation algorithm. The operations can correspondingly include employing the derived petrophysical properties evaluation algorithm to predict one or more petrophysical properties of the rock undergoing drilling real-time responsive to filtered data associated with raw acoustic sensor data produced in response to the drilling, as described, for example, with respect to the prior described bit-specific evaluation methodology.

According to various embodiments of the present invention, methods of analyzing properties of rock in a formation in real-time during drilling are also provided. For example, various embodiments of the methods include both computer employable steps (operations) as described with respect to the operations performed by the apparatus/program code, along with various non-computer implemented steps which provide substitutable replacements for the featured computer implemented steps, in conjunction with additional non-computer implemented steps as described below and/or as featured in the appended claims. Examples of various embodiments of the method are described below.

According to an embodiment of a method of analyzing properties of rock in a formation in real-time during drilling, the method can include the step of receiving raw acoustic sensor data from a data acquisition unit in communication with a surface data interface in further communication with a communication medium and further in communication with a downhole data interface operably coupled to a plurality of acoustic sensors. The method can also include various processing steps which include deriving a frequency distribution of the raw acoustic sensor data, deriving a plurality of acoustic characteristics including mean frequency and normalized deviation of frequency from the raw acoustic sensor data utilizing, for example, an acoustics characteristics evaluation algorithm, and/or deriving petrophysical properties from the raw acoustic sensor data utilizing, for example, a petrophysical properties evaluation algorithm employable to predict one or more petrophysical properties of rock undergoing drilling.

According to an embodiment of the method, the step of deriving a frequency distribution of the acoustic data from the raw acoustic sensor data includes transforming the raw acoustic sensor data into the frequency domain (e.g., employing a Fast Fourier Transform (FFT)), and filtering the transformed data.

According to an embodiment of the method, the step of deriving the plurality of acoustic characteristics from the raw acoustic sensor data can include providing the acoustic characteristics evaluation algorithm and comparing the mean frequency, the normalized deviation of frequency, the mean amplitude, the normalized deviation of amplitude, and the apparent power for the rock undergoing drilling with the mean frequency, normalized deviation of frequency, mean amplitude, normalized deviation of amplitude, and the apparent power for a plurality of rock samples having different known lithologies according to a first configuration, or comparing only part of the acoustic characteristics, such as the mean frequency and the normalized deviation of frequency of the rock undergoing drilling with the same type of the acoustic characteristics of a plurality of rock samples having different known lithologies according to another configuration. The method can also include identifying lithology type of the rock undergoing drilling, determining a location of a formation boundary encountered during drilling, and/or identifying an ideal location for casing shoe positioning, among others. According to an exemplary implementation, the mean frequency and normalized deviation of frequency are examined together to determine an amount of correlation of the acoustic characteristics associated with the rock undergoing drilling and the acoustic characteristics associated with the rock samples. Also or alternatively, the mean frequency and the mean amplitude can be examined together and/or with the normalized deviation of frequency and/or normalized deviation of amplitude, or a combination thereof. The step of comparing can beneficially be performed substantially continuously during drill bit steering in order to provide enhanced steering ability.

According to an embodiment of the method, the step of deriving petrophysical properties from the raw sensor data can include deriving a petrophysical properties evaluation algorithm for use in evaluating the received signals. The derivation of the algorithm can include collecting petrophysical properties data describing one or more petrophysical properties of rock for a plurality of formation samples and correspondent acoustic data for a preselected type of drill bit and processing the collected acoustic data to produce filtered FFT data. The algorithm derivation can also include determining one or more relationships between features of the filtered FFT data and correspondent one or more petrophysical properties of rock describing petrophysical properties of a plurality of formation samples, e.g., utilizing mathematical modeling techniques such as, multiple regression analysis, artificial neural network modeling, etc. The algorithm derivation can also include coding the determined relationships into computer program code defining the petrophysical properties evaluation algorithm. The derived algorithm can then be used in predicting one or more petrophysical properties of the rock undergoing drilling real-time responsive to filtered data associated with raw acoustic sensor data produced in response to the drilling.

According to an embodiment of the method, the step of deriving petrophysical properties from the raw sensor data can also or alternatively include deriving a petrophysical properties evaluation algorithm. The derivation of the algorithm can include collecting petrophysical properties data describing one or more petrophysical properties of rock for a plurality of formation samples and correspondent acoustic data for a plurality of different types of drill bits, processing the collected acoustic data to produce filtered FFT data, and determining bit-type independent features of the filtered FFT data. The algorithm derivation can also include determining one or more relationships between the bit-type independent features of the filtered FFT data and correspondent one or more petrophysical properties of the rock, e.g., using mathematical modeling techniques, such as artificial neural network modeling, etc., to provide a bit-independent evaluation methodology. The algorithm derivation can also include coding the determined relationships into computer program code defining the petrophysical evaluation properties algorithm. Correspondingly, the method can include employing the derived petrophysical properties evaluation algorithm to predict one or more petrophysical properties of the rock undergoing drilling real-time responsive to filtered data associated with raw acoustic sensor data produced in response to the drilling, as described, for example, with respect to the prior described bit-specific evaluation methodology.

Various embodiments of the present invention advantageously supply a new approach for a much better drilling steering. Various embodiments of the present invention provide apparatus and methods that supply detailed information about the rock that is currently in contact with the drilling bit, which can be used in real-time steering the drilling bit. That is, various embodiments of the present invention advantageously provide an employable methodology of retrieving a sufficient level of information so that the driller always knows the rock he is drilling, so that the drilling bit can be steered to follow the desire path more accurately than conventionally achievable. In comparison with conventional drilling steering tools, the real-time data provided by various embodiments of the present invention advantageously allow the driller to drill smoother lateral or horizontal wells with better contact with the production zone, to detect formation boundaries in real time, to detect the fractured zones in real time, and to perform further analysis on raw sensor data, if necessary.

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

Figures 1A, 1B:
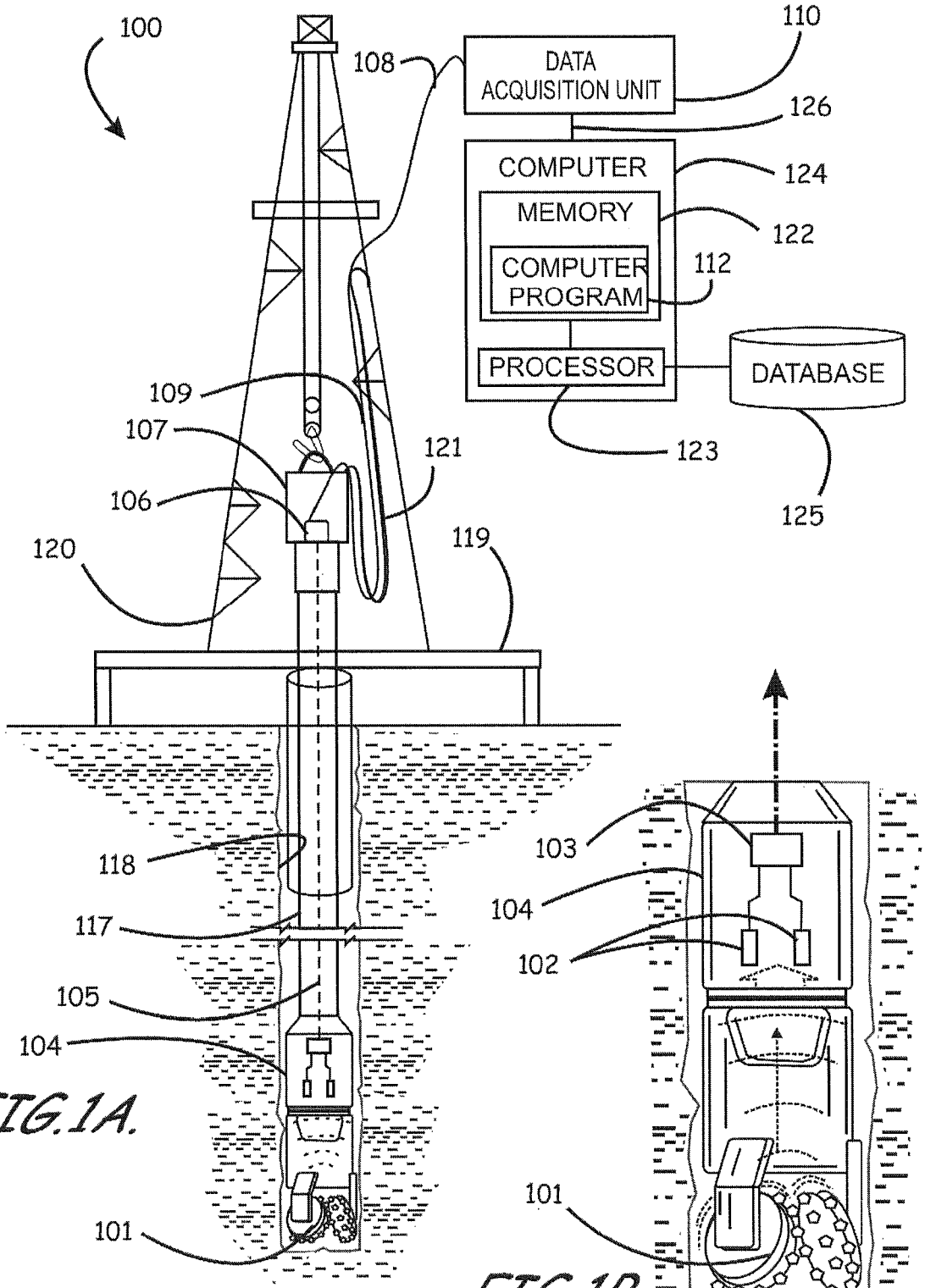
FIGS. 1A-1B is a partial perspective view and partial schematic diagram of a general architecture of an apparatus for identifying rock properties in real-time during drilling according to an embodiment of the present invention.

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime notation, if used, indicates similar elements in alternative embodiments.

When drilling into different lithologies or the same lithology with different properties (e.g., porosity, water saturation, permeability, etc.) the generated acoustic sounds emanating from the drill bit when drilling into rock, are distinctly different. The sounds, termed as drilling acoustic signals hereafter, transmit upward along the drill string. According to various embodiments of the present invention, a sensor subassembly containing acoustic sensors is positioned above the drill bit and connected to the above drill string. The drilling acoustic signals transmit from the drill bit to the sensor subassembly and are picked up by the acoustic sensors. The drilling acoustic signals received by the sensors are transmitted (generally after amplification) to surface by a borehole transmitting system which can include various components such as, for example, a downhole data interface, a broadband conductor, a surface data interface, etc. On the surface, the received acoustic signals are transformed by a data processing module into the frequency domain using, for example, a Fast Fourier Transformation (FFT) to generate FFT data (primarily the frequency and amplitude data). Some acoustic characteristics are derived directly from the FFT data. The frequency distribution and acoustic characteristics, for example, can be used immediately in some applications, such as lithology type identification and formation boundary determination. The FFT data can be further analyzed using a calibrated mathematical model, for the lithology type and petrophysical properties, which have wider applications than the direct results (frequency distribution and acoustic characteristics).

Where conventional measurement-while-drilling tools are typically located 30 to 50 feet behind the drill bit, beneficially, a major advantage of approaches employed by various embodiments of the present invention is that such approaches can derive information about lithologies from a position located at the cutting surface of the drill bit to provide such information to the operator steering the drill bit, in real time. This advantage makes aspects of various embodiments of the present invention ideal in the application of horizontal and lateral well drill steering, locating the relative position for setting the casing shoe, detecting fractured zones, and interpreting rock lithologies and petrophysical properties in real time.

FIGS. 1A-1B schematically show the setup of an exemplary apparatus for identifying rock properties in real-time during drilling 100. Acoustic sensors 102 are connected to a downhole data "transmitting" interface 103. According to the exemplary configuration, both are contained in a sensor subassembly 104, which is positioned above a drill bit 101 and connected to a drill string 117. In operation, the drilling acoustic signals are generated when the drill bit 101 bites rocks at the bottom of a borehole 118 during the drilling process.

Different acoustic sensors 102 may be used, e.g. accelerometer, measurement microphone, contact microphone, and hydrophone. According to the exemplary configuration, at least one, but more typically each acoustic sensor 102 either has a built-in amplifier or is connected directly to an amplifier (not shown). The drilling acoustic signals picked up by the acoustic sensors 102 are amplified first by the amplifier before transmitted to the downhole data interface 103.

From the downhole data interface 103, acoustic signals are transmitted to a surface data "transmitting" interface 106 through a borehole broadband data transmitting system 105. Currently, one commercially available broadband data transmitting system, NOV™ IntelliServ®, can transmit data at the rate of 1000,000 bit/s. A study indicated that with two acoustic sensors 102 at normal working sampling rate of 5 seconds per sample, the required data transmitting rate was about 41,000 bits/s. Therefore, the NOV™ IntelliServ® borehole broadband data transmitting system is an example of a broadband communication media capable of transmitting acoustic signals data for at least four acoustic sensors 102 to surface directly from a downhole data interface 103.

According to the exemplary configuration, the surface data interface 106 is located at the stationary part of the top drive 107. From the surface data interface 106, the acoustic signals are further transmitted to a data acquisition unit 110 through an electronic cable 108, which is protected inside a service loop 109. The data acquisition unit 110 is connected to a computer 124 through an electronic cable 126. The data acquisition unit 110 samples the acoustic signal in analog format and then converts the analog acoustic signals into digit data in FIG. 2.

Figure 2:
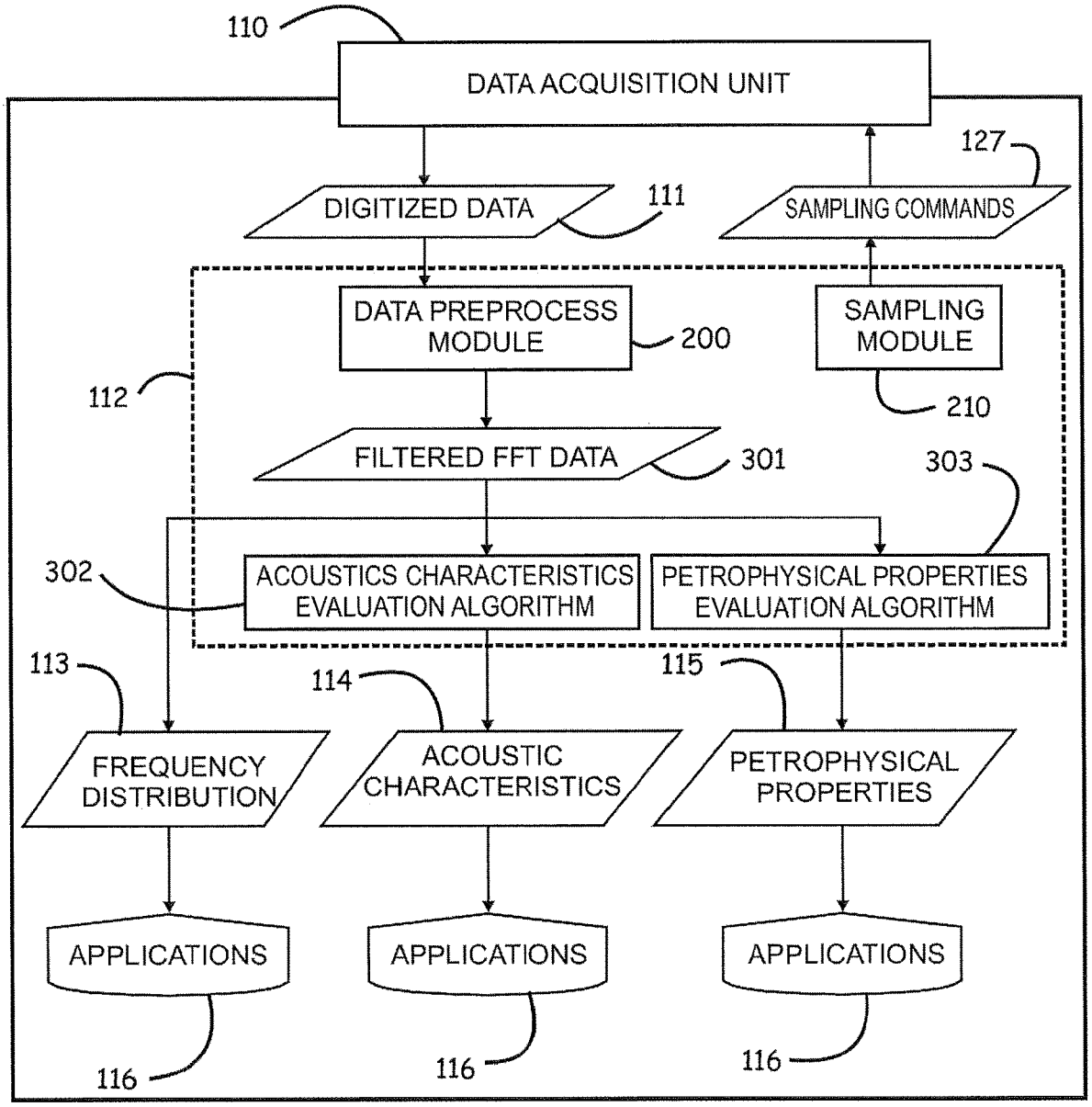
FIG. 2 is a schematic diagram showing a data processing procedure performed by a computer program according to an embodiment of the present invention.

Referring to FIGS. 1 and 2, the digitized data 111 is read by a computer program 112 (e.g., a petrophysical properties analyzing program), installed in memory 122 accessible to processor 123 of computer 124. The computer program 112 analyzes the digitized data 111 to derive a frequency distribution 113, acoustic characteristics 114, and petrophysical properties 115 of the rock undergoing drilling. The respective results, e.g., frequency distribution 113, acoustic characteristics 114, and petrophysical properties 115, can be used in various applications 116 to include lithology identification, drill bit steering, formation boundary identification, among others. Such data along with rock sample data, rock modeling data, etc. can be stored in database 125 stored in either internal memory 122 or an external memory accessible to processor 123.

Note, the computer 124 can be in the form of a personal computer or in the form of a server or server farm serving multiple user interfaces or other configurations known to those skilled in the art. Note, the computer program 112 can be in the form of microcode, programs, routines, and symbolic languages that provide a specific set or sets of ordered operations that control the functioning of the hardware and direct its operation, as known and understood by those skilled in the art. Note also, the computer program 112, according to an embodiment of the present invention, need not reside in its entirety in volatile memory, but can be selectively loaded, as necessary, according to various methodologies as known and understood by those skilled in the art. Still further, at least portions of the computer program 112 can be stored in memory of the sensor subassembly 104 when so configured.

Figure 3:
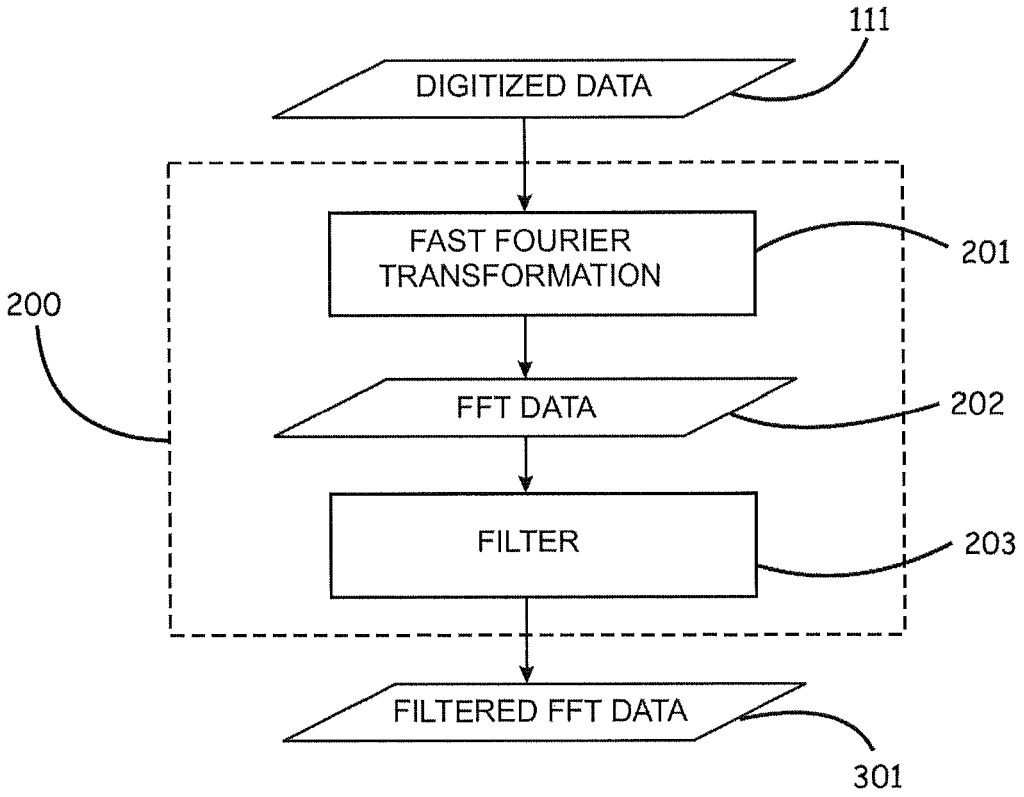
FIG. 3 is a schematic diagram illustrating a data preprocess module according to an embodiment of the present invention.

Referring to FIG. 3, according to the exemplary configuration, the digitized data 111 needs to be preprocessed before any use. According to the exemplary configuration, this is accomplished by a subroutine program referred to as data preprocess module 200. As illustrated in the figure, the digitized data is transformed into Fast Fourier Transform (FFT) data 202 by a FFT 201. The FFT data 202 is then filtered by a filter 203 to remove some low/high frequency and/or low amplitude data points, generated from other sources, i.e. not from the bit cutting into the rocks. The filtered FFT data 301 is then used in the various part of data process. Note the filtered FFT data 301 is relabeled as 403 in FIG. 7 and 503 in FIG. 8. Note also, the digitized data 111 is relabeled as 402 in FIG. 7, and 502 in FIG. 8.

Figure 4A:
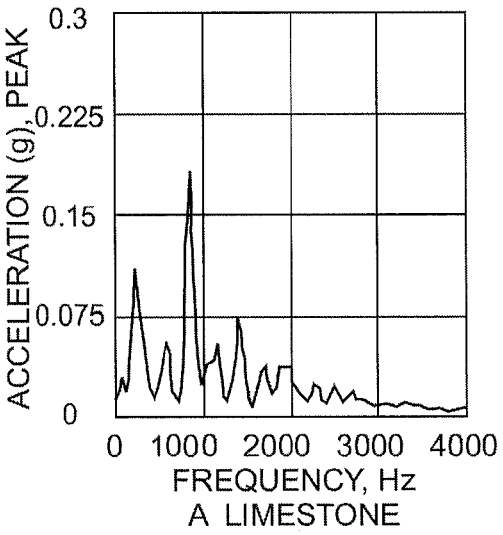
FIGS. 4A-4B are graphs illustrating examples of a frequency distribution of two types of carbonate according to an embodiment of the present invention.
Figure 4B:
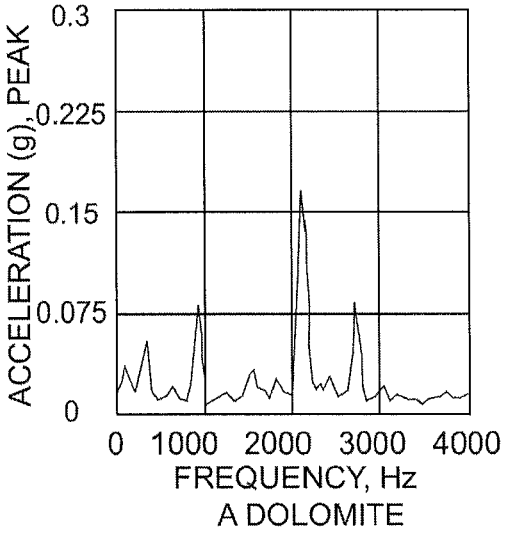

Major components and functions of the computer program 112 according to an exemplary configuration are detailed in FIG. 2. According to the exemplary configuration, there are four modules (components) in the computer program 112: a data preprocess module 200, a data sampling module 210, an acoustic characteristics evaluation algorithm 302, and a petrophysical properties evaluation algorithm 303. The sampling module 210 sends sampling commands 127, such as sampling rate, to the data acquisition unit 110 for data sampling control. The main part of the filtered FFT data 301 is a frequency distribution 113, which is the frequency and amplitude information of a sampled acoustic signal. Two examples of such signal are shown in FIGS. 4A and 4B. FIG. 4A illustrates the frequency distribution for a limestone and FIG. 4B illustrates the frequency distribution for a dolomite. A review of the frequency distribution of the two different types of carbonates illustrates how the frequency distribution can be used directly to distinguish lithologies.

According to the exemplary configuration, the frequency distribution 113 can be used directly in some applications, such as lithology type identification, formation boundaries determination, etc., represented by example at 116. The frequency distribution 113 can be plotted into time-frequency spectrum which can be used directly in some applications, such as lithology type identification, formation boundaries determination, etc., represented by example at 116.

Figure 5:
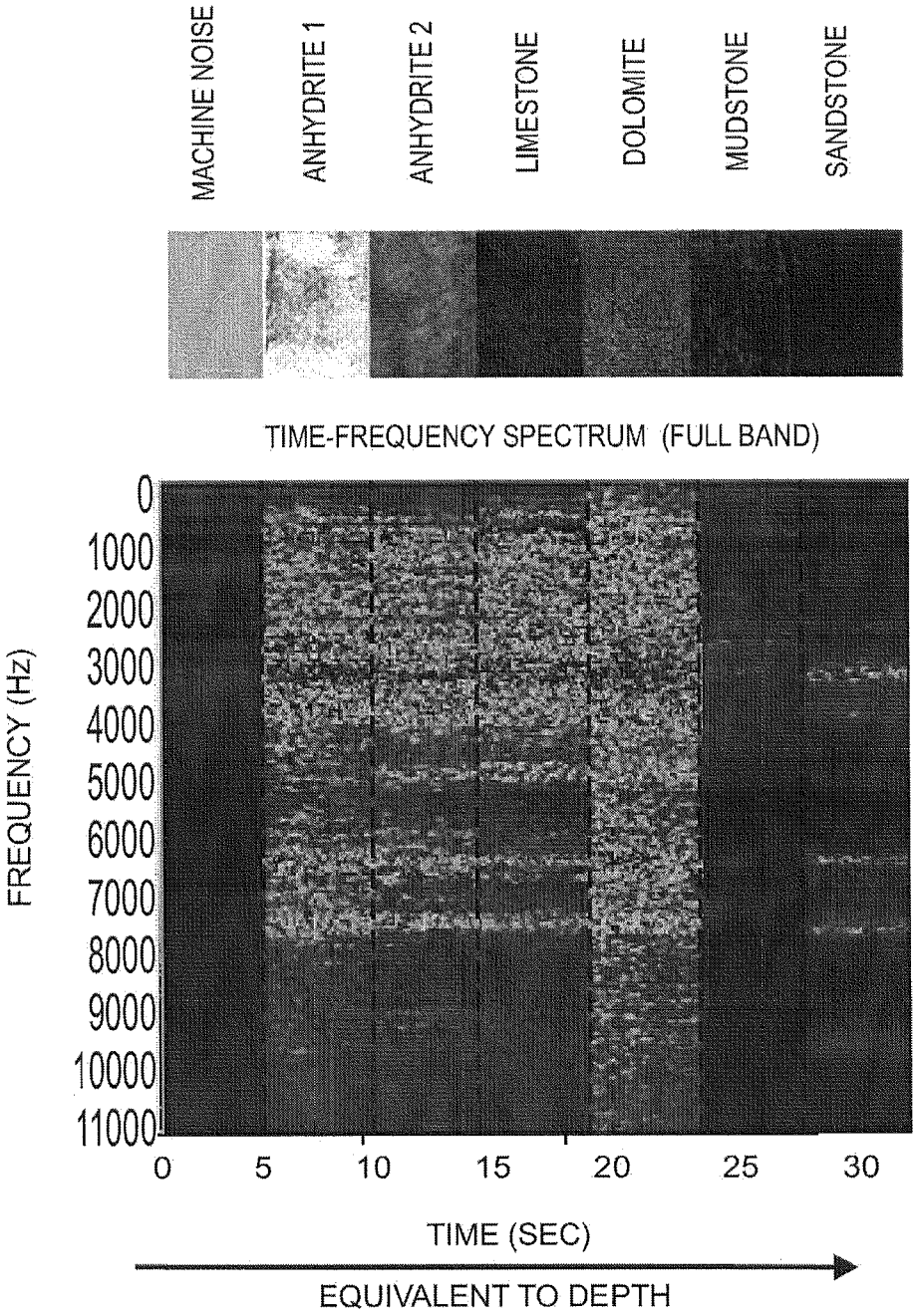
FIG. 5 is a graph illustrating a three dimensional depiction of the frequency distribution in correlation with various lithography types according to an embodiment of the present invention.

An example of such signal displaying diagram is shown in FIG. 5, which illustrates results of a laboratory experiment showing different lithologies have different frequency spectrums and lithology boundaries can be determined using the diagram. In FIG. 5, the color represents amplitude, with color normally displayed as red being highest (the intermixed color mostly concentrated just below the 4000 Hz range in this example) and the color normally displayed as blue being the lowest (the more washed out color in this example).

According to the exemplary configuration, an acoustic characteristics evaluation algorithm 302 evaluates the filtered FFT data 301 for select acoustic characteristics, such as, for example, mean frequency, normalized deviation of frequency, mean amplitude, normalized deviation of amplitude, and apparent power. These acoustic characteristics for an acoustic signal sample are defined as follows:

$$\mu_f = \frac{\sum_{i=1}^{n} A_i \cdot f_i}{\sum_{i=1}^{n} A_i} \tag{1}$$

-continued $$\sigma_{f_N} = \frac{1}{\mu_f}\sqrt{\sum_{i=1}^{n} \frac{A_i}{\sum_{i=1}^{n}}(f_i - \mu_f)^2} \tag{2}$$

$$\mu_A = \frac{1}{n}\sum_{i=1}^{n} A_i \tag{3}$$

$$\sigma_{A_N} = \frac{1}{\mu_A}\sqrt{\frac{1}{n}\sum_{i=1}^{n}(A_i - \mu_A)^2} \tag{4}$$

$$P_a = \sum_{i=1}^{n} A_i^2 f_i^2 \tag{5}$$

wherein:

$\mu_f$—mean frequency, Hz, $\sigma_{f_N}$—normalized deviation of frequency, Hz, $\mu_A$—mean amplitude, the unit depending on the type of acoustic sensor used in the measurement, $\sigma_{A_N}$—normalized deviation of amplitude, the unit depending on the type of acoustic sensor used in the measurement, $P_a$—apparent power, the unit depending on the type of acoustic sensor used in the measurement, $f_i$—frequency of the $i^{th}$ point of the acoustic signal sample, Hz, $A_i$—amplitude of the $i^{th}$ point of the acoustic signal sample, the unit depending on the type of acoustic sensor used in the measurement, and n—number of data points of the acoustic signal sample.

The mean frequency and the normalized deviation of frequency characterize the frequency distribution, while the mean amplitude and the normalized deviation of amplitude characterize the loudness level of the drilling sound. Apparent power represents the power of the acoustic signals. In the evaluation, these characteristics can be calculated within the whole range or a partial range of the frequency of the acoustic samples. The range is selected to achieve the maximum difference of these characteristics among different lithologies.

Figure 6:
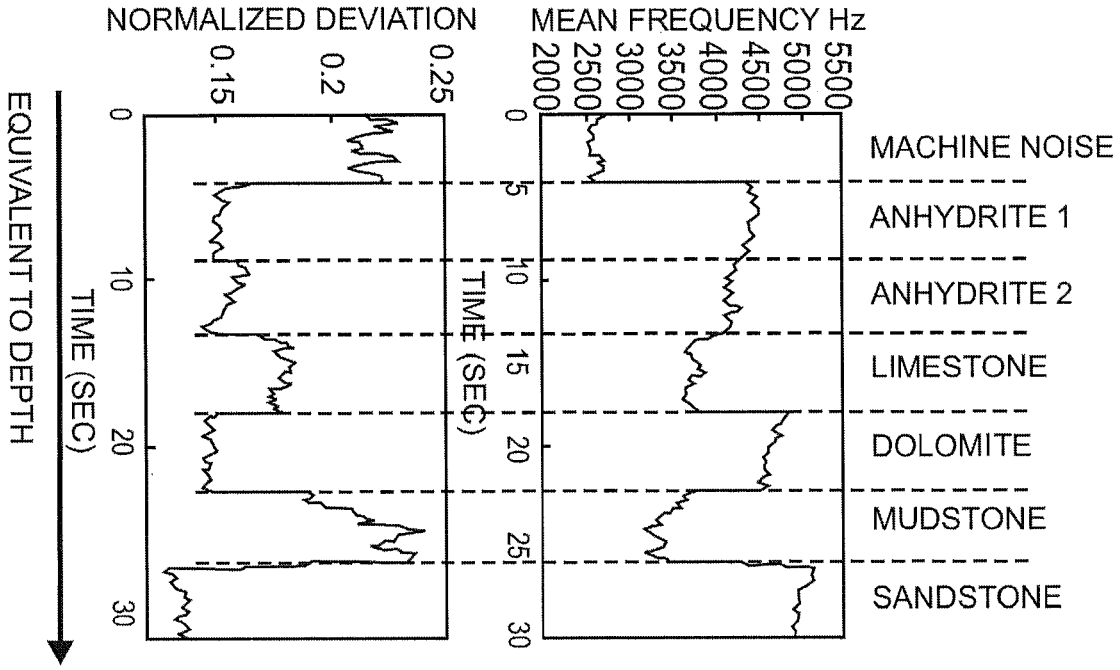
FIG. 6 is a graph illustrating a comparison of mean frequency and normalized deviation of frequency correlated with a plurality of lithology types according to an embodiment of the present invention.

The derived acoustic characteristics 114 can be used directly for certain applications, such as lithology type identification, formation boundary determination represented by example at 116. FIG. 6 illustrates results of a laboratory experiment showing that the mean frequency and normalized deviation of frequency correlated well with different lithology types.

According to an exemplary embodiment of the present invention, the mean frequency, the normalized deviation of frequency, the mean amplitude, the normalized deviation of amplitude, and/or the apparent power of the rock undergoing drilling can be compared with a corresponding mean frequency, normalized deviation of frequency, mean amplitude, normalized deviation of amplitude and/or apparent power of a plurality of rock samples having different known lithologies, to thereby determine an amount of correlation of the acoustic characteristics associated with the rock undergoing drilling and the acoustic characteristics associated with the rock samples. Responsively, the lithology type of the rock undergoing drilling can be determined.

Figure 7:
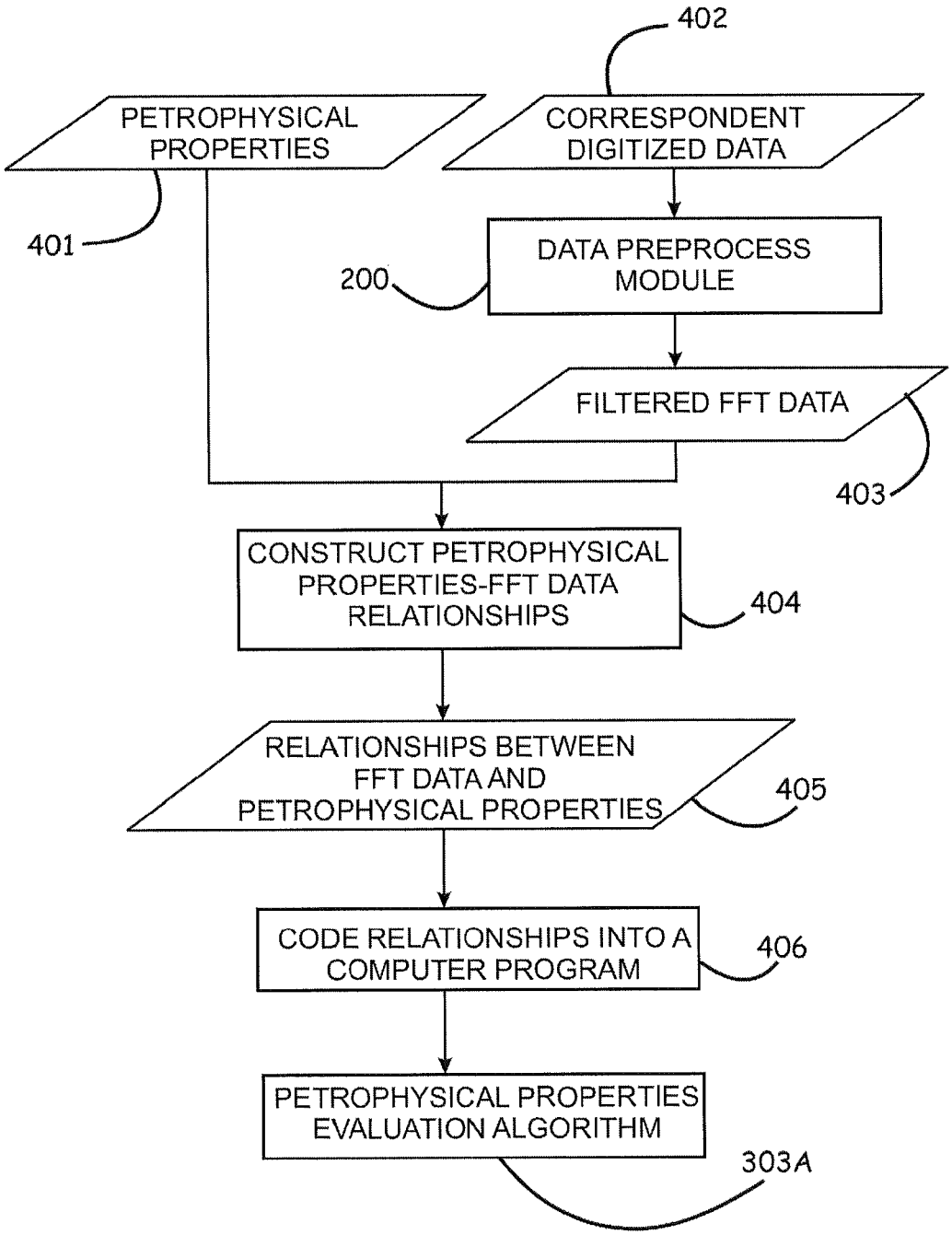
FIG. 7 is a schematic flow diagram illustrating steps for forming a petrophysical properties evaluation algorithm for a particular type of drill bit according to an embodiment of the present invention.
Figure 8:
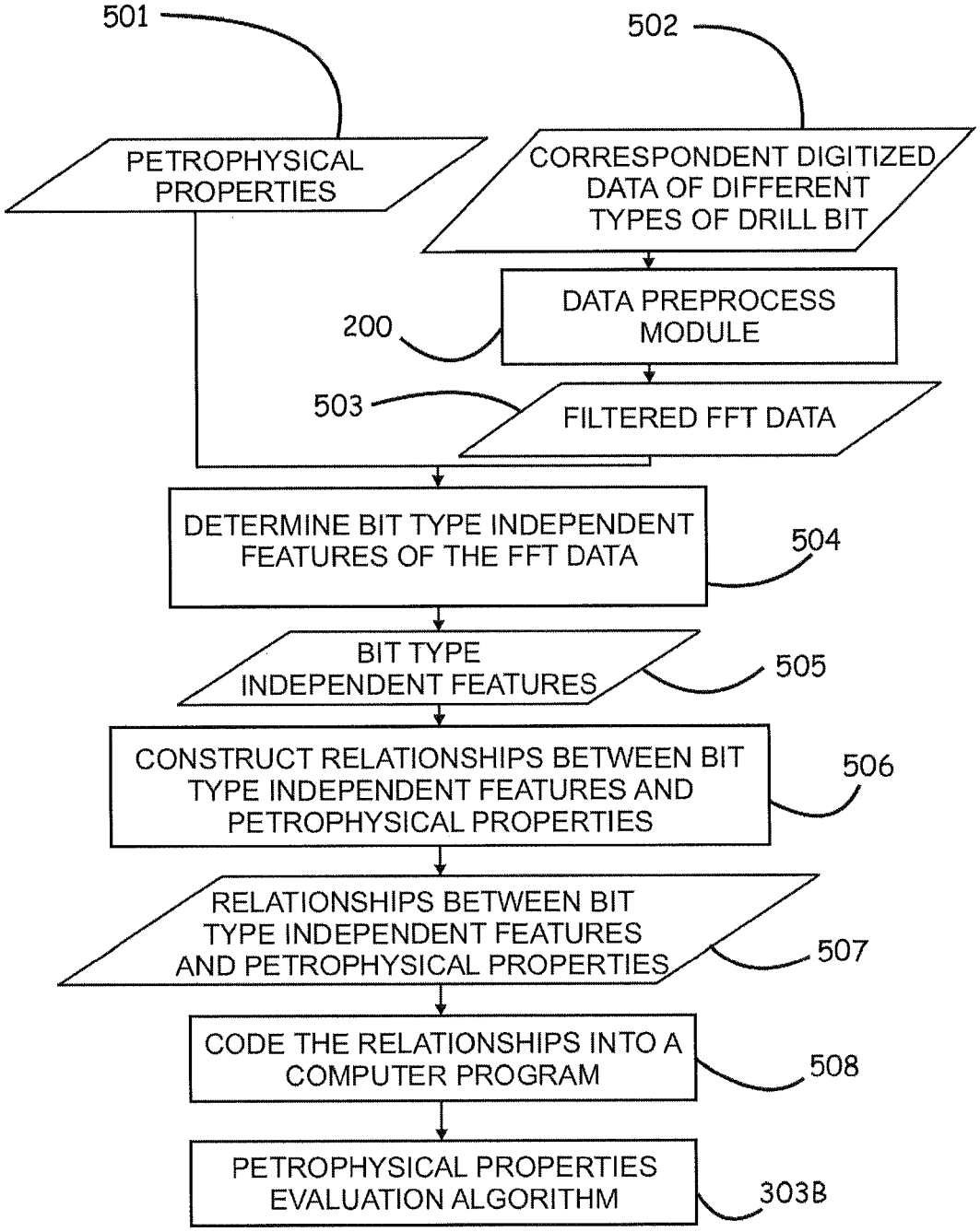
FIG. 8 is a schematic flow diagram illustrating steps for forming a drill bit independent petrophysical properties evaluation algorithm according to an embodiment of the present invention.

FIGS. 7 and 8 illustrate examples of the construction of two types of petrophysical properties evaluation algorithms 303: one designed for a particular type of drill bit shown at 303A and the other designed to be drill bit type independent shown at 303B. Unlike the FFT 201 and the acoustic characteristics evaluation algorithm 302, which are based on known mathematical equations, the petrophysical properties evaluation algorithm 303 is based on mathematical models, which are to be built utilizing acoustic data and petrophysical properties according to an exemplary configuration.

FIG. 7 illustrates the procedure for constructing a "Petrophysical Properties Evaluation Algorithm" for a particular type of drill bit. According to the exemplary configuration, datasets of petrophysical properties 401 and correspondent digitized acoustic data 402 for a particular drill bit are collected. The digitized acoustic data 402 is preprocessed by the data preprocess module 200 (referred to in FIG. 2) to produce the filtered FFT data 403. The relationships 405 between filtered FFT data 403 and petrophysical properties 401 are constructed (step 404) using suitable mathematical modeling techniques, such as, multiple regression analysis, artificial neural networks modeling. Once relationships 405 between the filtered FFT data 403 and petrophysical properties 401 are constructed, the relationships are coded (step 406) to produce a computer program, module, subroutine, object, or other type of instructions to define the "petrophysical properties evaluation algorithm" 303A. The algorithm 303A is then available to be used in the computer program 112 to predict the petrophysical properties from drilling acoustic signals for the particular drill bit type.

FIG. 8 illustrates the procedure for constructing a drill bit type independent "Petrophysical Properties Evaluation Algorithm" 303B. The datasets of petrophysical properties 501 and the correspondent acoustic data 502 measured from different types of drill bit are collected. The acoustic data 502 is preprocessed by the data preprocess module 200 (e.g., the module referred to FIGS. 2 and 3) to produce the filtered FFT data 503. Bit type independent features 505 of the filtered FFT data 503 are then determined by comparing the filtered FFT data of different types of drill bit and the correspondent petrophysical properties 501 (step 504). Features which have weakest correlation with the drill bit types and strong correlation with the petrophysical properties are the bit-type independent ones. The relationships 507 between the petrophysical properties 501 and the bit type independent features 505 are constructed (step 506) using suitable mathematical modeling techniques, such as, for example, multiple regression analysis, artificial neural networks modeling, among others. The constructed relationships 507 are then coded (step 508) into a computer program, module, subroutine, object, or other type of instructions to define the "petrophysical properties evaluation algorithm" 303B. The algorithm 303B is then available to be used in the computer program 112 to predict the petrophysical properties from drilling acoustic signals.

Application of the Results from the Processed Acoustic Signal.

One direct result is the frequency distribution 113 (FIG. 2), which may be used directly in lithology type identification, formation boundary determination. FIGS. 4A and 4B, for example, show the frequency distribution of two different types of carbonates. The figures illustrate that the frequency distribution can be used in the lithology type identification from matching a detective frequency distribution with a frequency distribution of a rock of known lithography type.

FIG. 6 demonstrates the feasibility of using acoustic characteristics 114 (FIG. 2) to derive lithology information. In FIG. 6, mean frequency and normalized deviation were calculated from FFT data of the drilling sounds of a sample corer drilling into cores of different lithologies. The figure demonstrates how the lithology types can be distinguished by the combination of the two characteristics: mean frequency and the normalized deviation of frequency. If mean amplitude and the normalized deviation of the amplitude are also used, an even better result may be achieved. The figure also inherently demonstrates that formation boundaries can be determined from acoustic characteristics. FIGS. 7 and 8 demonstrate the feasibility of building a petrophysical properties evaluation algorithm 303 (FIG. 2) which can be used to evaluate processed forms of the sound generated by operationally engaging the drilling bit with the rock being drilled.

Various embodiments of the present invention provide several advantages. For example, various embodiments of the present invention beneficially provide a means to identify lithology type and physical properties, truly in real-time. This advantage makes various embodiments of the present invention ideal in the applications of (1) horizontal and lateral well drill steering and (2) locating the relative position for setting the casing shoe at a much higher precision. Various embodiments can also be used to (3) detect fractured zones; and (4) interpret rock lithologies and petrophysical properties. Various embodiments of the present invention beneficially supply more information for evaluating petrophysical properties of the rocks, such as porosity, strength, and presence of hydrocarbons, through the utilization of data obtained through the analysis of acoustic signals to evaluate these petrophysical properties. Such data can beneficially be beyond that which can be conventionally supplied.

This application is a divisional of and claims priority to U.S. patent application Ser. No. 13/554,077, titled "Apparatus, Computer Readable Medium, And Program Code For Evaluating Rock Properties While Drilling Using Downhole Acoustic Sensors And A Downhole Broadband Transmitting System," filed on Jul. 20, 2012, which is a non-provisional of and claims priority to and the benefit of U.S. Provisional Patent Application No. 61/539,165, titled "Apparatus And Program Product For Evaluating Rock Properties While Drilling Using Downhole Acoustic Sensors and a Downhole Broadband Transmitting System," filed on Sep. 26, 2011, each incorporated herein by reference in its entirety. This application is related to U.S. patent application Ser. No. 13/554,369, filed on Jul. 20, 2012, titled "Methods of Evaluating Rock Properties While Drilling Using Downhole Acoustic Sensors and a Downhole Broadband Transmitting System"; U.S. patent application Ser. No. 13/554,019, filed on Jul. 20, 2013, titled "Apparatus, Computer Readable Medium and Program Code for Evaluating Rock Properties While Drilling Using Downhole Acoustic Sensors and Telemetry System"; U.S. patent application Ser. No. 13/553,958, filed on Jul. 20, 2012, titled "Methods of Evaluating Rock Properties While Drilling Using Downhole Acoustic Sensors and Telemetry System"; U.S. patent application Ser. No. 13/554,298, filed on Jul. 20, 2012, titled "Apparatus for Evaluating Rock Properties While Drilling Using Drilling Rig-Mounted Acoustic Sensors"; and U.S. patent application Ser. No. 13/554,470, filed on Jul. 20, 2012, titled "Methods for Evaluating Rock Properties While Drilling Using Drilling Rig-Mounted Acoustic Sensors"; U.S. Provisional Patent Application No. 61/539,171, titled "Methods Of Evaluating Rock Properties While Drilling Using Downhole Acoustic Sensors And A Downhole Broadband Transmitting System," filed on Sep. 26, 2011; U.S. Provisional Patent Application No. 61/539,201, titled "Apparatus For Evaluating Rock Properties While Drilling Using Drilling Rig-Mounted Acoustic Sensors," filed on Sep. 26, 2011; U.S. Provisional Patent Application No. 61/539,213, titled "Methods For Evaluating Rock Properties While Drilling Using Drilling Rig-Mounted Acoustic Sensors," filed on Sep. 26, 2011; U.S. Provisional Patent Application No. 61/539,242 titled "Apparatus And Program Product For Evaluating Rock Properties While Drilling Using Downhole Acoustic Sensors And Telemetry System," filed on Sep. 26, 2011; and U.S. Provisional Patent Application No. 61/539,246 titled "Methods Of Evaluating Rock Properties While Drilling Using Downhole Acoustic Sensors And Telemetry System," filed on Sep. 26, 2011, each incorporated herein by reference in its entirety.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification.

That claimed is:

1. A method for analyzing properties of rock in a formation in real-time during drilling, the method comprising:

sending sampling commands to a surface data acquisition unit in communication with a downhole data interface through a surface data interface and a communication medium extending between the surface data interface and the downhole data interface, the downhole data interface operably coupled to a plurality of acoustic sensors carried by a downhole sensor assembly, receiving digitized raw acoustic sensor data from the surface data acquisition unit, the digitized raw acoustic sensor data representing an acoustic signal generated real-time as a result of rotational contact of a drill bit with rock during drilling;

transforming the raw acoustic sensor data into the frequency domain;

filtering the transformed data; and deriving a plurality of acoustic characteristics from the filtered data, the plurality of acoustic characteristics including mean frequency and normalized deviation of frequency;

comparing the mean frequency and the normalized deviation of frequency of the rock undergoing drilling with mean frequency and normalized deviation of frequency of a plurality of rock samples having different known lithologies; and identifying lithology type of the rock undergoing drilling responsive to the operation of comparing.

2. The method of claim 1, wherein the mean frequency and normalized deviation of frequency are examined together as part of the comparing to thereby determine an amount of correlation of the acoustic characteristics associated with the rock undergoing drilling and the acoustic characteristics associated with the rock samples.

3. The method of claim 1, wherein the plurality of acoustic characteristics further include mean amplitude, normalized deviation of amplitude and apparent power, the method further comprising:

comparing the mean frequency, the normalized deviation of frequency, the mean amplitude, the normalized deviation of amplitude, and the apparent power for the rock undergoing drilling with mean frequency, normalized deviation of frequency, mean amplitude, normalized deviation of amplitude, and apparent power for a plurality of rock samples having different known lithologies to thereby determine an amount of correlation of the acoustic characteristics associated with the rock undergoing drilling and the acoustic characteristics associated with the rock samples, and identifying lithology type of the rock undergoing drilling responsive to the operation of comparing.

4. The method of claim 1, wherein the plurality of acoustic characteristics further include mean amplitude, normalized deviation of amplitude, and apparent power, the method comprising:

comparing the mean frequency, the normalized deviation of frequency, the mean amplitude, the normalized deviation of amplitude, and the apparent power for the rock undergoing drilling with mean frequency, normalized deviation of frequency, mean amplitude, normalized deviation of amplitude, and apparent power for a plurality of rock samples having different known lithologies to thereby determine an amount of correlation of the acoustic characteristics associated with the rock undergoing drilling and the acoustic characteristics associated with the rock samples, and determining a location of a formation boundary encountered during drilling responsive to the operation of comparing.

5. The method of claim 1, comprising providing the lithology type of the rock undergoing drilling to a driller to assist in drilling operations.

6. A method for analyzing properties of rock in a formation in real-time during drilling, the method comprising:

sending sampling commands to a surface data acquisition unit in communication with a downhole data interface through a surface data interface and a communication medium extending between the surface data interface and the downhole data interface, the downhole data interface operably coupled to a plurality of acoustic sensors carried by a downhole sensor assembly, receiving digitized raw acoustic sensor data from the surface data acquisition unit, the digitized raw acoustic sensor data representing an acoustic signal generated real-time as a result of rotational contact of a drill bit with rock during drilling;

transforming the raw acoustic sensor data into the frequency domain;

filtering the transformed data; and deriving petrophysical properties from the filtered data utilizing a petrophysical properties evaluation algorithm employable to predict one or more petrophysical properties of rock undergoing drilling.

7. The method of claim 6, wherein the one or more petrophysical properties comprise: lithology type, porosity, water saturation, and permeability of rock undergoing drilling.

8. The method of claim 6, wherein the one or more petrophysical properties comprise: presence of hydrocarbons in rock undergoing drilling when existing and presence of fractures in the rock undergoing drilling when existing.

9. The method of claim 6, wherein the petrophysical properties evaluation algorithm is a bit-specific petrophysical properties evaluation algorithm, the method comprising:

collecting petrophysical properties data describing one or more petrophysical properties of rocks contained in a data set and correspondent acoustic data for a preselected type of drill bit;

processing the collected acoustic data to produce filtered FFT data;

determining one or more relationships between features of the filtered FFT data and correspondent one or more petrophysical properties of rocks for the preselected type of drill bit; and coding the determined relationships into computer program code defining the petrophysical properties evaluation algorithm; and wherein the operation of deriving the petrophysical properties includes employing the petrophysical properties evaluation algorithm to predict one or more petrophysical properties of the rock undergoing drilling real-time responsive to filtered data associated with raw acoustic sensor data produced in response to the drilling.

10. The method of claim 6, wherein the collected petrophysical properties data describes petrophysical properties of a plurality of samples taken from the formation undergoing drilling operations.

11. The method of claim 6, wherein the petrophysical properties evaluation algorithm is a bit-independent petrophysical properties evaluation algorithm, the method comprising:

collecting petrophysical properties data describing one or more petrophysical properties of rocks and correspondent acoustic data for a plurality of different types of drill bits;

processing the collected acoustic data to produce filtered FFT data;

determining bit-type independent features of the filtered FFT data;

determining one or more relationships between the bit-type independent features of the filtered FFT data and correspondent one or more petrophysical properties of the rocks; and coding the determined relationships into computer program code defining the petrophysical properties evaluation algorithm; and wherein the operation of deriving the petrophysical properties includes employing the petrophysical properties evaluation algorithm to predict one or more petrophysical properties of the rock undergoing drilling real-time responsive to filtered data associated with raw acoustic sensor data produced in response to the drilling.

12. The method of claim 11, wherein the collected petrophysical properties data describes petrophysical properties of a plurality of samples taken from the formation undergoing drilling operations.

13. The method of claim 6, comprising providing the one or more petrophysical properties of rock undergoing drilling to a driller to assist in drilling operations.

14. A method for analyzing properties of rock in a formation in real-time during drilling, the method comprising:

receiving raw acoustic sensor data from a surface data acquisition unit in communication with a downhole data interface through a surface data interface and a communication medium extending between the surface data interface and the downhole data interface, the downhole data interface operably coupled to a plurality of acoustic sensors; and deriving a plurality of acoustic characteristics from the raw acoustic sensor data, the plurality of acoustic characteristics including mean frequency and normalized deviation of frequency.

15. The method of claim 14, the method further comprising sending sampling commands to the data acquisition unit, and deriving a frequency distribution of the acoustic data from the raw acoustic sensor data, wherein deriving a frequency distribution comprises:

transforming the raw acoustic sensor data into the frequency domain; and filtering the transformed data.

16. The method of claim 14, wherein the plurality of acoustic characteristics further include mean amplitude, normalized deviation of amplitude, and apparent power, the method comprising:

comparing the mean frequency, the normalized deviation of frequency, the mean amplitude, the normalized deviation of amplitude, and the apparent power for the rock undergoing drilling with mean frequency, normalized deviation of frequency, mean amplitude, normalized deviation of amplitude, and apparent power for a plurality of rock samples having different known lithologies, the mean frequency and normalized deviation of frequency being examined together and the mean frequency and the mean amplitude being examined together to determine an amount of correlation of the acoustic characteristics associated with the rock undergoing drilling and the acoustic characteristics associated with the rock samples, the operation of comparing being performed substantially continuously during drill bit steering; and performing one or more of the following responsive to the operation of comparing:

identifying lithology type of the rock undergoing drilling, and determining a location of a formation boundary encountered during drilling.

17. A method for analyzing properties of rock in a formation in real-time during drilling, the method comprising:

receiving raw acoustic sensor data from a surface data acquisition unit in communication with a downhole data interface through a surface data interface and a communication medium extending between the surface data interface and the downhole data interface, the downhole data interface operably coupled to a plurality of acoustic sensors; and deriving petrophysical properties from the raw acoustic sensor data utilizing a petrophysical properties evaluation algorithm employable to predict one or more petrophysical properties of rock undergoing drilling.

18. The method of claim 17, wherein the petrophysical properties evaluation algorithm is a bit-specific petrophysical properties evaluation algorithm, the method comprising:

collecting petrophysical properties data describing one or more petrophysical properties of rocks for a plurality of formation samples and correspondent acoustic data for a preselected type of drill bit;

processing the collected acoustic data to produce filtered FFT data;

determining one or more relationships between features of the filtered FFT data and correspondent one or more petrophysical properties of rocks describing petrophysical properties of a plurality of formation samples for the preselected type of drill bit; and coding the determined relationships into computer program code defining the petrophysical properties evaluation algorithm; and wherein the operation of deriving the petrophysical properties includes employing the petrophysical properties evaluation algorithm to predict one or more petrophysical properties of the rock undergoing drilling real-time responsive to filtered data associated with raw acoustic sensor data produced in response to the drilling.

19. The method of claim 17, wherein the petrophysical properties evaluation algorithm is a bit-independent petrophysical properties evaluation algorithm, the method comprising:

collecting petrophysical properties data describing one or more petrophysical properties of rocks for a plurality of formation samples and correspondent acoustic data for a plurality of different types of drill bits;

processing the collected acoustic data to produce filtered FFT data;

determining bit-type independent features of the filtered FFT data;

determining one or more relationships between the bit-type independent features of the filtered FFT data and correspondent one or more petrophysical properties of the rocks; and coding the determined relationships into computer program code defining the petrophysical properties evaluation algorithm; and wherein the operation of deriving the petrophysical properties includes employing the petrophysical properties evaluation algorithm to predict one or more petrophysical properties of the rock undergoing drilling real-time responsive to filtered data associated with raw acoustic sensor data produced in response to the further drilling.

* * * * *